United States Patent [19]

Ebeling et al.

[11] Patent Number: 4,705,120

[45] Date of Patent: Nov. 10, 1987

[54] DRILLING MACHINE

[75] Inventors: Wolfgang Ebeling, Hannover; Helmut Kolditz, Wolfenbüttel, both of Fed. Rep. of Germany

[73] Assignees: Turmag Turbo-Maschinen-AG, Nuesse & Graefer, Sprockhoevel; Gesellschaft fuer Strahlen-und Umweltsforschung Muenchen mbH (GSF), Neuherberg, both of Fed. Rep. of Germany

[21] Appl. No.: 903,118

[22] Filed: Sep. 2, 1986

[51] Int. Cl.[4] ..... E21B 4/02

[52] U.S. Cl. ..... 175/99; 299/31

[58] Field of Search ..... 175/99, 394; 299/18, 299/31, 33, 56, 67

[56] References Cited

U.S. PATENT DOCUMENTS

| | | | |
|---|---|---|---|
| 2,637,527 | 5/1953 | Andrews, Jr. | 175/99 |
| 4,274,675 | 6/1981 | Paurat et al. | 299/31 |
| 4,275,926 | 6/1981 | Hodges | 299/18 |
| 4,406,498 | 9/1983 | Akesaka | 299/33 |
| 4,474,253 | 10/1984 | Kleuters | 175/99 |
| 4,543,019 | 9/1985 | Shikata | 175/394 |

FOREIGN PATENT DOCUMENTS 2849245 6/1982 Fed. Rep. of Germany .

*Primary Examiner*—Stephen J. Novosad
*Assistant Examiner*—William P. Neuder
*Attorney, Agent, or Firm*—Michael J. Striker

[57] ABSTRACT

A drilling machine for drilling descending large boreholes in earth or rock structures, comprises an elongated drill pipe driven by a drive machine positioned outside a borehole being drilled, a drill head connected to said pipe and a support device for a drill head. A fluid-supplying device having a descending conduit, supplying fluid from the fluid supplying device to the drill head, is further provided in the drilling machine. A sluice charged with the mixture of the material drilled and the fluid is arranged in the drill head and driven by the drillpipe. The support device is secured in the machine against rotation.

21 Claims, 4 Drawing Figures

DRILLING MACHINE

BACKGROUND OF THE INVENTION

The present invention relates to a drilling machine.

A drilling machine of the type under consideration includes an elongated drill pipe driven by a drive positioned outside a borehole being drilled and driving a drill head. Such drilling machines have been utilized for drilling boreholes in rock structures or ground. The drilling machine of the foregoing type has been provided with a support device and water-jet installation by which water is supplied via a descending conduit to the region of the drill head. Water is mixed in that region with the drilled material so that a material-fluid mixture is formed, which is transported via an ascending conduit extending through the drill pipe from the drill head to the borehole mouth.

A drilling machine of the type under discussion has been disclosed for example in DE-PS No. 28 49 245 and "Braunkohle", Heft 7, 1983, page 3. In the drilling machines shown in these disclosure, pressure air is fed in the ascending conduit in accordance with the known air-lifting-drilling process, and an uplift is generated in the conduit. There is an assumption that filling of the borehole with the liquid is the situation which is not acceptable, for example in cases of blind mines and swelling, loose and/or cracked rock.

DE-PS No. 28 49 245 teaches the drilling machine in which a rotatable supporting device which does not serve for supporting a torque of the transmission driven by the drill rod and arranged in the drill head. This device cannot be used for driving a conveying aggregate.

Since the proposed invention relates to the drilling machine for drilling boreholes of large diameters such a machine should be provided with a direct rinsing because otherwise required raising speeds for the material transporting can not be obtained in the borehole. Known hydraulic suction transporting devices require a complete filling of the borehole with the liquid. Pneumatic suction transporting means has the disadvantage which resides in that due to limits by atmospheric air pressure the structure of such pneumatic means is expensive and energy consumption is high.

SUMMARY OF THE INVENTION

It is an object of the present invention to provide an improved drilling machine for drilling boreholes in rock structures or the like.

It is another object of this invention to provide a drilling machine which is used for drilling mine boreholes and provided with the drill head driven by the elongated drill pipe in accordance with the principle of pneumatic or hydraulic pressure conveying with high efficiency.

These and other objects of the invention are attained by a drilling machine for drilling descending large boreholes in earth or rock structures, comprising an elongated drill pipe driven by a drive machine positioned outside a borehole being drilled; a drill head connected to said pipe; a support device for a drill head; a fluid-supplying device having a descending conduit supplying fluid from said fluid supplying device to said drill head, said fluid being mixed in a region of said drill head with a material being drilled and forming a fluid-material mixture; an ascending conduit extending through said drill pipe and transporting said mixture from said drill head to a borehole mouth; and a sluice arranged in said drill head and driven by said drill pipe, said support device being secured against rotation.

The sluice is driven by the drill pipe. The sluice can be formed as a lock with a chamber. Thereby the material-and-fluid mixture is brought into the sluice near the drill head and from hence it is hydraulically or pneumatically transported by a pressure conveyance via the ascending conduit to the mouth of the borehole. For this transport, a hydraulic means such as a pump can be installed above the borehole mouth, or a pneumatic means such a a compressor can be connected to the descending conduit. The fluid compressed via the descending conduit to the sluice is emptied therefrom continually by the water-jet installation. Such drilling machine normally requires a plurality of main transporting pumps and is very costly also due to extensive wear of its structural components. Furthermore, with conventional drilling machines having drill heads driven by the elongated drill pipes dispensable packers are required, the function of which is to seal against the rock structure, this has also created further problems.

In the drilling machine disclosed in Delmann-Haniel GmbH, Dortmund, No. 29/1981, a pneumatic transport device in a mine has been utilized, which has been provided with a bucket wheel-blowing machine. However, that blowing machine could not be adjusted to the drilling machine of the foregoing type.

According to one of the embodiments of this invention, the sluice may be a bucket wheel sluice positioned centrally of said drill head and coaxially with said drill pipe, said sluice having a bucket wheel which is in a driving connection with said drill pipe. Thereby the bucket wheel can be set in rotation by the transmission between the bucket wheel and the drill pipe or by the planetary gear supported on the support device for the drill head.

The drill head may be provided with a planetary drive and a pilot drill, said pipe having a hollow channel, said sluice having an outlet channel connected to said hollow channel.

The pilot drill may have a housing supporting said bucket wheel and having a head portion, a sleeve portion and a bottom wall portion, said head portion and said bottom wall portion being connected to said pilot drill for joint rotation, said bucket wheel having a central shaft which is rotatable with said bucket wheel between said head portion and said bottom wall portion. Thus the bottom wall or portion is rotated in the direction opposite to that of the shaft and/or with a higher speed. The relative number of revolution of the bucket wheel and the bucket wheel housing is selected so that a required pressure conveyance with a required speed and output of the material fluid mixture in connection with the ascending and descending conduits are obtained.

In order to continully transport the material into the sluice the pilot drill may be provided at a front side thereof with drilling tools and with a helical spiral at said sleeve portion. The helical spiral transports the drilled material collected near the tools to the head portion of the housing of the bucket wheel. Since the bucket wheel is closed at its periphery and is emptied via the outlet channel the material enters the bucket wheel when the spiral ends at least at the level of the inlet channel.

Enlarging tools may be provided at least at the level of said inlet opening in said head portion, said spiral terminating at said level. These enlarging tools may be planetary cutting discs, roller tools or the like so that the material drilled can flow from the faces being treated in the direction towards the pilot drill and thus in the direction of the inlet channel of the sluice.

The bucket wheel can be driven by said central shaft, said central shaft may be an elongated bore, two series of radial bores branched off said elongated bore and positioned above and below said bucket wheel, respectively, said head portion having an annular channel connected to the series of radial bores positioned above said bucket wheel, said drill head having a feeding conduit connected to said descending conduit which supplies fluid to said drill head, said feeding conduit opening into said annular channel.

The bottom wall portion may be formed with a widening channel, the series of the radial bores positioned in said shaft below said bucket wheel opening into said widening channel.

The pilot drill may be provided with an energy storing means, said bottom wall portion being axially displaceable to said shaft against a force of said energy storing means and against said bucket wheel.

The energy storing means may include a spring positioned at said bottom wall, said pilot drill having an inner wall, said spring being supported at one end thereof against said bottom wall and at another end against said inner wall.

The energy-storing means may further include a cylinder-piston unit positioned at said bottom wall in a region of the greatest pressure loading an having a one piston end loaded with the material-and-fluid mixture and another piston end supported against said inner wall.

A release opening may be formed in said bottom wall between said outlet channel and said inlet channel in a direction of rotation of said bucket wheel, said release opening being connected with a release channel ending in a free space of the borehole being drilled.

The support drive may include at least one groove milling cutter and at least one guide ski corresponding to said milling cutter.

The support device may include at least two pairs of diametrically opposite guide skis of which one pair is positioned near said drill head and the other pair is spaced at a predetermined distance from said one pair along an axis of said drill pipe, and further include a connection member, said two pairs of skis being in connection with said drill pipe by said connection member.

The drilling machine may further include a prestressed spring, at least said milling cutter and said guide ski being radially inwardly displaceable against a force of said prestressed spring.

The pair of said guide skis which is positioned closer to the mouth of the borehole being drilled may be provided at front sides thereof with cutting blades.

A feeding conduit may be provided in said drill head, said feeding conduit being connected to said fluid supplying conduit.

At least one non-rotational guide may be provided on said drill pipe, and guide having at least one ski engaging in grooves formed by said groove milling cutter, said fluidsupplying conduit being connected to said guide.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
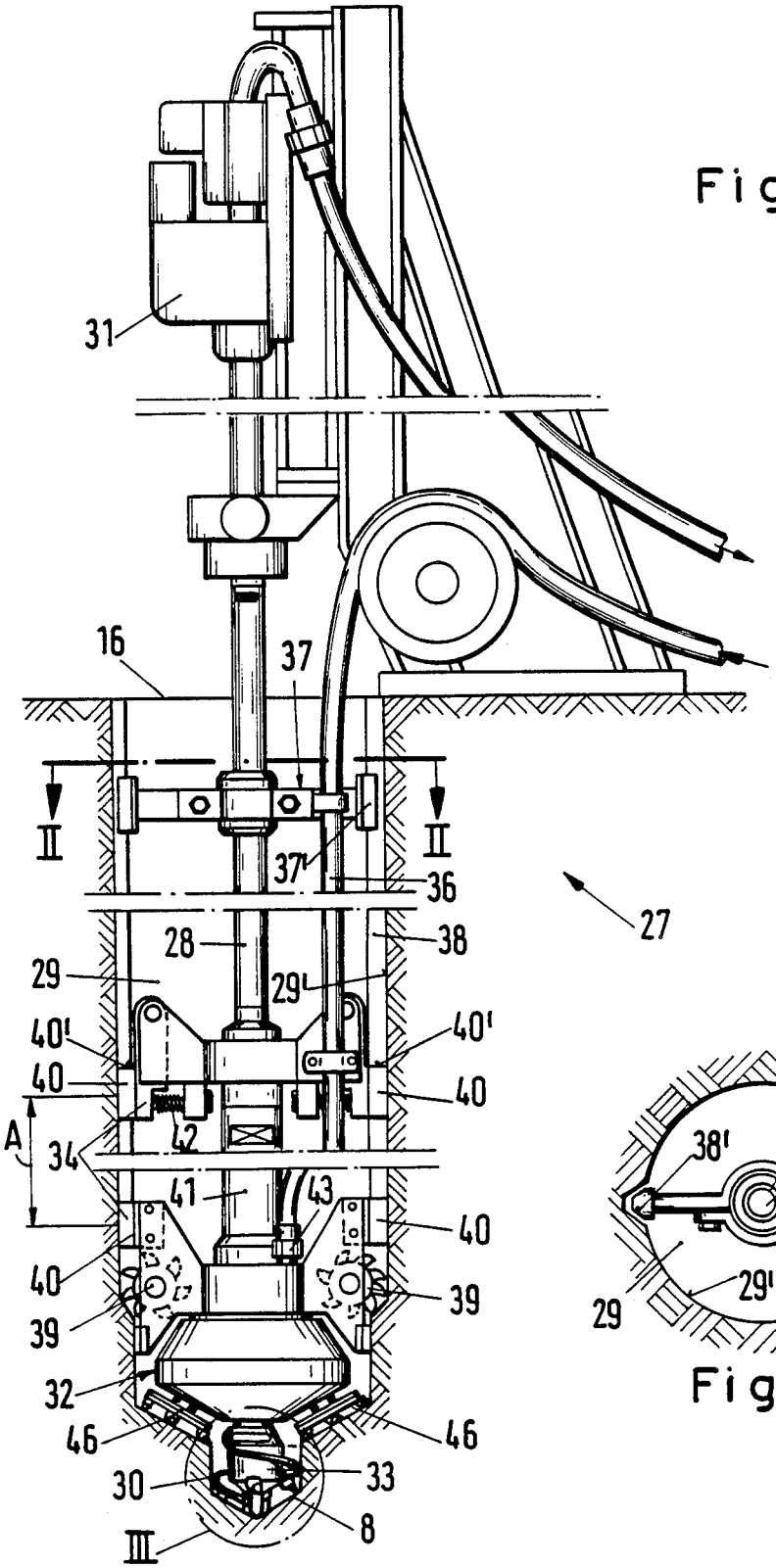
FIG. 1 is a schematic side view of the drilling machine according to the invention.
Figure 2:
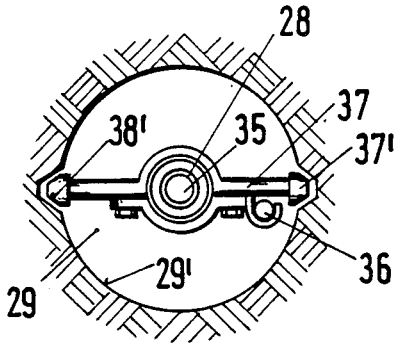
FIG. 2 is a sectional view on line II—II of FIG. 1.

Referring now to the drawings in detail, it will be seen that a drilling machine according to the invention denoted in toto by reference numeral 27 includes an elongated drilling pipe 28 which is connected outside a bore hole 29 being drilled with a drive machine 31. Drill pipe 28 driven by the machine 31 drives a drill head 32. A charging sluice 30,which will be described in detail below,is arranged in a pilot drill 33 of the drill head 32. The drill head 32 is provided with a support device 34 which is secured against rotation.

An ascending conduit 35 is formed by a hollow channel extending through the elongated drill rod 28. A descending conduit 36 is also provided, which is comprised of a tubular conduit or hose and is secured on a rod guide 37 which is engaged by means of skis 37' in grooves 38 which are pre-cut in a borehole wall 29' by groove milling cutters 39 which belong to the support device 34. This support device has in addition to the milling cutters 39 at least one guiding ski (40) corresponding to these groove milling cutters 39. The latter are in the driving connection with the drill pipe 28 via the non-shown but conventional transmission means.

In the preferred embodiment the support device 34 is comprised of at least two pairs of diametrically opposing guiding skis 40 of which one pair is positioned in the proximity of the drill head 32 and the other pair is positioned at a predetermined distance A from the drill head whereby both pairs of skis are in connection with each other via a specific bending-resistant connection member 41, which can be for example a thickened portion of the drill rod. At least one groove milling cutter 39 and/or one guiding ski 40 of the support device 34 are radially inwardly displaceable against the force of a prestressed spring 42. The guiding ski 40 which is closer to the borehole mouth 16 is formed at its upper side 40' as a cutter so as to facilitate lifting of the drill head 21 upon convergence of the borehole 29. This guidance of the skis 37' of the rod guide 37 in the grooves 38 ensures a reliable holding of the descending conduit 36 without danger of complications with the drill rod. Thereby a very expensive multi-channel drill rod can be omitted.

Figure 3:
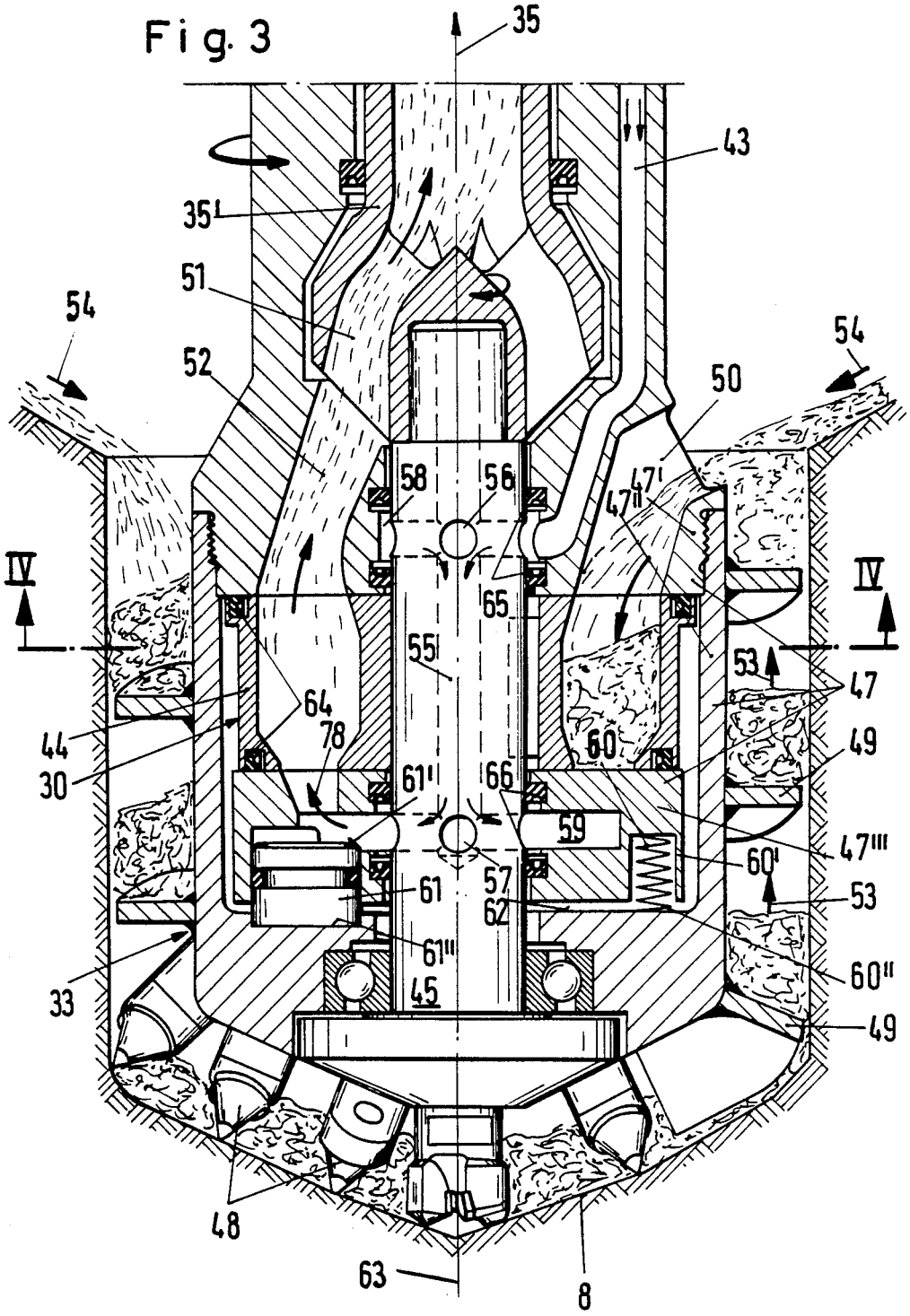
FIG. 3 is an enlarged view indicated at III in FIG. 1.

Near the drill pipe 28 as mentioned above,hose 36 extends through the borehole 29, this hose for feeding fluid is connected to a feeding conduit 43 for the bucket wheel sluice 30 in the drill head 32. As shown in FIG. 3, feeding conduit 43 is connected to the bucket wheel sluice 30 provided in a pilot drill 33 of the drill head 32. The bucket wheel sluice 30 is coaxial with the drill rod 28, extending through the center of the drill head 32 whereby a bucket wheel 44 is in a driving connection with the drill pipe 28 via a bucket wheel shaft 45.

In the preferred embodiment the drill head 32 is provided with a non-shown but known planetary drive, by means of which cutting discs 46 shown in FIG. 1 are driven.

Referring back to FIG. 3 it will be seen that a bucket wheel housing 47 is formed by a head portion 47', a portion of a sleeve 47' of the pilot drill 33 and a bottom wall 47'''. The head portion 47' and bottom wall 47''' are connected with pilot drill 33 for joint rotation. Between the head portion 47' and bottom wall 47''',the bucket wheel 44 is rotationally supported with the bucket wheel shaft 45.

The pilot drill 33 is provided at the front side thereof with drilling tools 48 and a helical spiral 49 on the outer sleeve 47''. The bucket wheel 44 is closed at its periphery and is filled via an inlet opening 50 with a drill material-fluid mixture 51 in the head portion 47' of the bucket wheel housing 47 and is emptied via an outlet channel 52 provided in the head portion 47'. The sluice 30 is connected by this outlet channel 52 with a hollow channel 35 of the drill rod 28, by means of which the material-fluid mixture 51 is discharged outside through the borehole mouth 16.

Inasmuch as the pilot drill 33 rotates during operation with the number of revolutions depending on the speed of the drill head 32 so rotates also sleeve 47' and spiral 49. Thereby the drilled material is conveyed in the direction of arrow 53 from the base of the borehole 8 upwardly at least up to the level of the inlet opening 50 in the head portion 47' of the housing 47. At least at the level of the inlet opening 50 are positioned enlarging drilling tools 46 in the form of planetary cutting discs to facilitate the flow of drilled material moving in the direction towards the inlet opening 50. The bucket wheel 40 is driven by the shaft 45. The latter has an elongated bore 55 and a plurality of radial bores 56, 57 branching off the bore 55 and positioned below and above the bucket wheel 44. Radial bores 56 merge into an annular channel 58 formed on the head portion 47' of the housing 47. Feeding conduit 43 for fluid opens into the annular channel 58. Radial bores 57 which are positioned below the bucket wheel 44 and arranged in the shaft 45 open into a widening channel 59 formed in the bottom wall 47''' of housing 47.

The bottom wall 47''' is axially pressed towards the shaft 45 against the force of energy-storing elements 60 relative to the bucket wheel 44. The energy-storing elements 60 include springs 60 mounted at the bottom wall 47'''. Springs 50 are supported at one ends against the bottom wall 47''' of housing 47 and at the other ends against an inner wall 62 of the pilot drill 3.

For minimizing the gap between the bucket wheel 44, on the one hand, and the head portion 47' of housing 47, on the other hand, bottom wall 47''' is provided, at its region of the largest pressure loading with at least one piston-cylinder unit 61 arranged parallel to the axis of rotation 63 of the shaft 45. A piston end 61' of the piston-cylinder unit 61 is loaded with the material-fluid mixture while the cylinder of this unit is formed by a recess provided in the bottom wall 47'''. The other piston end 62'' is supported against the inner wall 62 of the pilot drill 33.

The pilot drill 33 in the drilling machine according to the invention rotates with its tools 48 with the number of revolutions adjusted to the operation of the drill head 32 while the bucket wheel 44 rotates relative to the pilot drill, in the opposite direction and with a different speed. These relative speed differences between the bucket wheel housing 47 and the bucket wheel 44, besides other factors, such as for example, flow speed of the material-fluid mixture 51, are important for volumes of the material-fluid mixture 51 per time unit discharged via the outlet opening 52. To make these factors more effective a sealing is provided between the bucket wheel 44 and head portion 47' and the bottom wall 47''' of housing 47. This sealing is accomplished by minimizing the gap as mentioned above, by means of lip-shaped sealings 64 which can be, of course, replaced by any other suitable sealings. The annular chamber 58 is also sealed by lip-shaped sealings 65 whereas the enlargement or widening portion 59 in the bottom wall 47''' is sealed by further lip-shaped sealings 66. Air can be utilized as the fluid for the drilling process. This also has the advantage if a non-firm rock is treated or if a liquid as a fluid is undesired.

Figure 4:
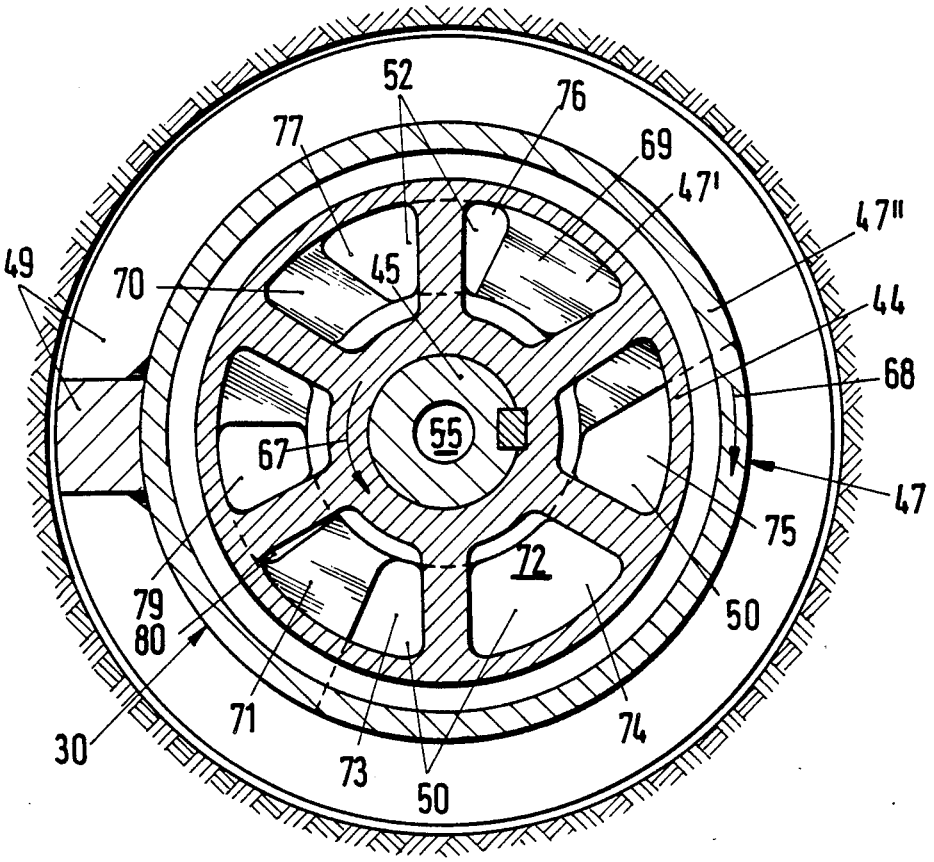
FIG. 4 is a sectional view on line IV—IV of FIG. 3.

With reference to FIG. 4, the function of the charging sluice 30 will be now described. The bucket wheel 44 rotates in the direction of arrow 67 while the housing 47 is moved in the direction of arrow 68. Thereby by the bucket wheel 44, three(crosshatched)overlapping regions 69, 70 and 71 are formed. These regions are different in size and belong to the head portion 47' of the housing 47. The bucket wheel is provided with six evenly sized chambers 72 which have substantially the shape of circular rings. In the direction of rotation of arrow 67 of the bucket wheel 44, starts the filling in the field 73'' (non hatched) which is followed by a field 74 and ends in a field 75.

Three chamber regions 73, 74, 75 can be filled during the movement phase with the material-fluid mixture flowing through the inlet opening 50 into the head portion 47' of the housing 47. These chambers are covered by the overlapping region 69 in the head portion 47' and are sealed relative to the inlet opening 50.

At chamber regions 76 and 77 the material-fluid mixture escapes so that the mixture flows over the feeding conduit 43, the annular chamber 58, radial bores 56, axial bore 55 and again via radial bores 57 into the widening portion 59 and then in the direction of arrow 78 away from the chamber regions 76, 77 into the outlet 52 from which the mixture is transported through the hollow channel 35 in the drill pipe 28 and borehole mouth 16.

Relatively wider overlapping region 70 in the head portion 47' of housing 47 is connected to both chamber regions 76, 77. Housing 47 must be sealed relative to the outer regions 76, 77. These regions form a pressure-releasing area which is constituted by small chambers 79 and 80. In the movement phase the small chambers 79 and 80 are in connection via a non-shown channel in the drill head 32 with the borehole 29 so that in the emptying phase chambers 72 of the bucket wheel 44 set under pressure can release this pressure without providing a vortex of the mixture near the inlet opening 50 and reducing the degree of filling of the sluice 30.

The releasing regions 79, 80 again connect the filling and inlt regions 73, 74, 74 for refilling the individual chambers 83.

It is of course understood that the drilling machine can be modified within the limits of the invention. For example, a mechanical supply of a drill material 54 may be replaced by a pneumatic or hydraulic supply. The energy-storing elements 60 can be made as pneumatically or hydraulically operated cylinder-piston units.

It will be understood that each of the elements described above, or two or more together, may also find a useful application in other types of drilling machines differing from the types described above.

While the invention has been illustrated and described as embodied in a drilling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drilling machine for drilling descending large boreholes in earth or rock structures, comprising an elongated drill pipe driven by a drive machine positioned outside a borehole being drilled; a drill head connected to said pipe; a support device for a drill head; a fluid-supplying device having a descending conduit supplying fluid from said fluid sypplying device to said drill head, said fluid being mixed in a region of said drill head with a material being drilled and forming a fluid-material mixture; an ascending conduit extending through said drill pipe and transporting said mixture from said drill head to a borehole mouth; and aa sluice (30) arranged in said drill head and receiving said mixture and connected to said ascending conduit for discharging said mixture thereto and driven by said drill pipe, said support device (34) being secured against rotation, said sluice being positioned centrally of said drill head and coaxially with said drill pipe, said sluice being formed by a bucket wheel which is in a driving connection with said drill pipe.

2. The machine as defined in claim 1, wherein said drill head is provided with a planetary drive and a pilot drill (33), said pipe having a hollow channel (35), said sluice having an outlet channel (52) connected to said hollow channel.

3. The machine as defined in claim 2, wherein said pilot drill has a housing (47) supporting said bucket wheel and having a head portion (47'), a sleeve portion (47'') and a bottom portion (47'''), said head portion and said bottom portion being connected to said pilot drill for joint rotation, said bucket wheel having a central shaft (45) which is rotatable with said bucket wheel between said head portion and said bottom wall portion.

4. The machine as defined in claim 3, wherein said pilot drill is provided at a front side thereof with drilling tools (48) and with a helical spiral at said sleeve portion.

5. The machine as defined in claim 4, wherein said bucket wheel is closed at a periphery thereof, said head portion having an inlet channel (50) and said outlet channel (52), said bucket wheel being filled with said mixture at said inlet channel and emptied at said outlet channel.

6. The machine as defined in claim 5, wherein enlarging tools (46) are provided at least at the level of said inlet opening in said head portion, said spiral terminating at said level.

7. The machine as defined in claim 6, wherein said bucket wheel is driven by said central shaft, said central shaft (45) having an elongated bore (55), two series of radial bores (56, 57) branched off said elongated bore and positioned above and below said bucket wheel, respectively, said head portion having an annular channel (58) connected to the series of radial bores positioned above said bucket wheel, said drill head having a feeding conduit (43) connected to said descending conduit which supplies fluid to said drill head, said feeding conduit opening into said annular channel.

8. The machine as defined in claim 7, wherein said bottom wall is formed with a widening channel (59), the series of the radial bores (57) positioned in said shaft below said bucket wheel opening into said widening channel.

9. The machine as defined in claim 8, further including energy storing means (60, 61) positioned in said pilot drill, said bottom wall portion being axially displaceable to said shaft against a force of said energy storing means and against said bucket wheel.

10. The machine as defined in claim 9, wherein said energy storing means include a spring (60) positioned at said bottom wall portion, said pilot drill having an inner wall (62), said spring being supported at one end thereof against said bottom wall and at another end against said inner wall.

11. The machine as defined in claim 10, wherein said energy-storing means further include a cylinder-piston unit (61) positioned at said bottom wall portion in a region of the greatest pressure loading and having a one piston end (61') loaded with the material-fluid mixture and another piston end (61'') supported against said inner wall.

12. The machine as defined in claim 11, wherein a release opening (78) is formed in said head portion between said outlet channel (52) and said inlet channel (50) in a direction of rotation (67) of said bucket wheel, said release opening being connected with a release channel ending in a free space of the borehole being drilled.

13. The machine as defined in claim 11, wherein a release opening is formed in said bottom wall portion between said outlet channel (52) and said inlet channel (50) in a direction of rotation of said bucket wheel, said release opening being connected with a release channel ending in a free space of the borehole being drilled.

14. The machine as defined in claim 1, wherein said support device (34) includes at least one groove milling cutter (39) and at least one guide ski (40) corresponding to said milling cutter.

15. The machine as defined in claim 14, wherein said milling cutter is in a driving connection with said drill pipe via a transmission.

16. The machine as defined in claim 15, wherein said support device includes at least two pairs of diametrically opposite guide skis (40) of which one pair is positioned near said drill head and the other pair is spaced at a predetermined distance from said one pair along an axis of said drill pipe, and further including a connection member (41), said two pairs of skis being in connection with said drill pipe by said connection member.

17. The machine as defined in claim 16; further including a prestressed spring (42), at least said milling cutter and said guide ski being radially inwardly displaceable against a force of said prestressed spring.

18. The machine as defined in claim 17, wherein said one pair of said guide skis which is positioned closer to the mouth of the borehole being drilled may be provided at upper sides thereof with cutting blades (40').

19. The machine as defined in claim 18, wherein a feeding conduit (43) is provided in said drill head, said feeding conduit being connected to said fluid supplying conduit (36).

20. The machine as defined in claim 19, wherein at least one non-rotational guide (37) is provided on said drill pipe, said guide having at least one ski (37') engaging in grooves (38) formed by said groove milling cutter (39), said fluid-supplying conduit being connected to said guide.

21. A drilling machine for drilling descending large boreholes in earth or rock structures, comprising an elongated drill pipe driven by a drive machine positioned outside a borehole being drilled; a drill head connected to said pipe; a support device for a drill head; a fluid-supplying device having a descending conduit supplying fluid from said fluid supplying device to said drill head, said fluid being mixed in a region of said drill head with a material being drilled and forming a fluid-material mixture; an ascending conduit extending through said drill pipe and transporting said mixture from said drill head to a borehole mouth; a sluice (30) arranged in said drill head and driven by said drill pipe, said support device (34) being secured against rotation, said sluice being formed by a bucket wheel driven by said drill pipe; and a pilot drill (33) on said drill head, said pilot drill having a housing (47) supporting said bucket wheel and having a head portion (47'), a sleeve portion (47'') and a bottom portion (47'''), said head portion and said bottom portion being connected to said pilot drill for joint rotation, said bucket wheel having a central shaft (45) which is rotatable with said bucket wheel between said head portion and said bottom wall portion.

* * * * *